US009644162B2

(12) United States Patent
Muldowney

(10) Patent No.: US 9,644,162 B2
(45) Date of Patent: May 9, 2017

(54) FUEL ADDITIVE AND FUEL COMPOSITION

(71) Applicant: Motor Sports Fuel and Equipment, Burnsville, MN (US)

(72) Inventor: Daniel Muldowney, Eden Prairie, MN (US)

(73) Assignee: Motor Sports Fuel and Equipment, Burnsville, MN (US)

( * ) Notice: Subject to any disclaimer, the term of this patent is extended or adjusted under 35 U.S.C. 154(b) by 0 days.

(21) Appl. No.: 14/780,281

(22) PCT Filed: Mar. 26, 2014

(86) PCT No.: PCT/US2014/031909

§ 371 (c)(1),
(2) Date: Sep. 25, 2015

(87) PCT Pub. No.: WO2014/160802

PCT Pub. Date: Oct. 2, 2014

(65) Prior Publication Data

US 2016/0040086 A1 Feb. 11, 2016

Related U.S. Application Data

(60) Provisional application No. 61/805,732, filed on Mar. 27, 2013, provisional application No. 61/970,527, filed on Mar. 26, 2014.

(51) Int. Cl.

| | |
|---|---|
| ***C10L 1/00*** | (2006.01) |
| ***C10L 10/10*** | (2006.01) |
| ***C10L 1/14*** | (2006.01) |
| ***C10L 1/18*** | (2006.01) |
| *C10L 1/16* | (2006.01) |
| *C10L 1/185* | (2006.01) |
| *C10L 1/30* | (2006.01) |

(52) U.S. Cl.

CPC ..... *C10L 10/10* (2013.01); *C10L 1/14* (2013.01); *C10L 1/16* (2013.01); *C10L 1/18* (2013.01); *C10L 1/30* (2013.01); *C10L 1/1608* (2013.01); *C10L 1/1616* (2013.01); *C10L 1/1852* (2013.01); *C10L 1/305* (2013.01); *C10L 2200/0254* (2013.01); *C10L 2270/023* (2013.01); *C10L 2290/24* (2013.01)

(58) Field of Classification Search

CPC .... C10L 10/10; C10L 1/14; C10L 1/16; C10L 1/18; C10L 1/30; C10L 2200/0254; C10L 2270/023; C10L 2290/24

See application file for complete search history.

(56) References Cited

U.S. PATENT DOCUMENTS

| | | | | |
|---|---|---|---|---|
| 6,238,446 | B1 | 5/2001 | Henderson | |
| 6,258,134 | B1 | 7/2001 | Studzinski et al. | |
| 8,628,594 | B1 * | 1/2014 | Braly | C10L 1/06 44/426 |
| 8,741,126 | B2 * | 6/2014 | Demoment | C10L 1/06 208/16 |
| 2012/0247003 | A1 | 10/2012 | Baustian et al. | |

FOREIGN PATENT DOCUMENTS

WO 2010077161 A2 7/2010

OTHER PUBLICATIONS

International Searching Authority, PCT Notification of Transmittal of the International Search Report and the Written Opinion, Aug. 18, 2014, 13 pages.

K.V.N. Suresh Reddy, P. Srinivasa Rao, A. Krishnaiah, Experimental and theoretical values of sound speeds and viscosities for the binary systems of MTBE with hydrocarbons, Feb. 23, 2007, 7 pages.

faqs.org, Automotive Gasoline—Part 1 of 4, Nov. 17, 1996, 28 pages.

smokemup.com, Fuel Comparison: Gasoline, Methanol, Nitromethane, 2 pages.

espn.com: Nextelcup, A lesson in Racing Fuels 101, Oct. 9, 2007, 3 pages.

* cited by examiner

*Primary Examiner* — Cephia D Toomer

(74) *Attorney, Agent, or Firm* — Kinney & Lange, P.A.

(57) ABSTRACT

A fuel additive includes methyl tert-butyl ether in an amount between 35% and 55% by weight, saturated hydrocarbons in an amount between 25% and 35% by weight and methylcyclopentadienyl manganese tricarbonyl in an amount between 3% and 12% by weight.

16 Claims, No Drawings

FUEL ADDITIVE AND FUEL COMPOSITION

BACKGROUND

High performance engines are used in cars, trucks, motorcycles, boats, jet skis and other motorized vehicles. Using ordinary gasoline in a high performance engine can lead to severe damage and problems that render the engine unusable. As a result, high octane racing fuel is typically used in high performance engines during races and other events.

However, U.S. federal laws restrict the transportation of racing fuels. Taxes imposed on the transport of racing fuel lead racers to bring minimal amounts of fuel to a race, only the amount they think they need. As a result, some racers can be left at the track with too little fuel to complete a race. The alternative is to pay tax on fuel that goes unused at the race.

In addition, the person transporting the fuel is responsible for the compliance of Department of Transportation (DOT), National Transportation Safety Board (NTSB) and Environmental Protection Agency (EPA) requirements for the transportation of fuel. Should an accident occur, the person transporting the fuel may face stiff penalties if he isn't in compliance with these requirements.

The quality and octane of distilled racing fuel can vary widely based on how the fuel is stored and handled. When gasoline is stored at less than optimal conditions the olefins in the fuel tend to decompose, forming gums. This decomposition process has a negative effect on the overall octane of the stored fuel. The introduction of water in the form of condensation and exposure to air can also decrease the octane and quality of stored racing fuel. When storage tanks (whether in the ground, in a vehicle or in a garage) are subjected to cycles of hot and cold, condensation can form in the tank, adding water to the fuel. This negatively affects the octane of the fuel. High performance engines can also suffer damage due to oxidation processes caused by the exposure of fuel to water and/or air.

Many automotive enthusiasts build street cars and motorcycles with high performance/high compression engines. Like race engines these engines require racing fuel. However, racing fuel is difficult to obtain so owners of these cars are forced to retard engine timing to keep the engine from detonating. The net result is that the engine generates less power and is less efficient than it would be with high octane fuel.

SUMMARY

A fuel additive includes methyl tert-butyl ether in an amount between 35% and 55% by weight, saturated hydrocarbons in an amount between 25% and 35% by weight and methylcyclopentadienyl manganese tricarbonyl in an amount between 3% and 12% by weight.

A fuel composition includes a major amount of a mixture of hydrocarbons in the gasoline boiling range and a minor amount of a fuel additive. The fuel additive includes methyl tert-butyl ether in an amount between 35% and 55% by weight, alkanes in an amount between 25% and 35% by weight, and methylcyclopentadienyl manganese tricarbonyl in an amount between 3% and 12% by weight.

A method of increasing the octane rating of a fuel includes adding a fuel additive to the fuel and mixing the fuel additive and the fuel. The fuel additive includes methyl tert-butyl ether in an amount between 35% and 55% by weight, alkanes in an amount between 25% and 35% by weight, and methylcyclopentadienyl manganese tricarbonyl in an amount between 3% and 12% by weight.

DETAILED DESCRIPTION

The present disclosure relates to fuel additives for liquid fuel compositions. When added to a liquid fuel composition, the fuel additives described herein provide a higher-octane fuel composition that provides engines with increased average and peak torque and horsepower. Fuel additives according to the present disclosure can increase the octane rating of a liquid fuel composition by as many as 14 full octane numbers or 140 points of octane.

Fuel additives according to the present disclosure include an oxygenate, an organometallic compound and saturated hydrocarbons (alkanes). One example of a suitable oxygenate is methyl tert-butyl ether (MTBE). In some embodiments the fuel additive contains between 35% and 55% MTBE by weight. In more preferable embodiments, the fuel additive contains between 45% and 50% MTBE by weight. One example of a suitable organometallic compound is methylcyclopentadienyl manganese tricarbonyl (MMT). In some embodiments the fuel additive contains between 3% and 12% MMT by weight. In more preferable embodiments, the fuel additive contains between 3% and 5% MMT by weight. In some embodiments the fuel additive contains between 25% and 35% saturated hydrocarbons by weight. One example of a saturated hydrocarbon is heptane. In some embodiments the fuel additive contains between 28% and 35% heptane by weight. In some embodiments, the saturated hydrocarbons are isoalkanes. Examples of isoalkanes include isopentane, isoheptane and isooctane.

MMT has been previously used to boost the octane rating of a fuel. However, MMT has a point of diminishing return where higher concentrations of MMT significantly increase fuel cost while providing little additional increase in octane rating. According to the present disclosure, the disclosed concentrations of MTBE, MMT and saturated hydrocarbons provide a synergistic effect that increases fuel performance beyond expected levels. The synergistic combination of MTBE, MMT and saturated hydrocarbons yields a fuel additive that increases the octane rating of fuels, engine horsepower and engine torque, allowing ordinary gasoline to function as an effective fuel for high performance engines.

The fuel additive can also contain other compounds including, but not limited to, toluene, heavy naphtha, naphthalene, trimethylbenzene, benzene and ethylbenzene. Heavy naphtha refers to liquid hydrocarbons that typically contain 6-12 carbon atoms and boil between about 90° C. and about 200° C. In some embodiments the fuel additive contains between 6% and 12% toluene by weight, between 5% and 11% heavy naphtha by weight, between 0.5% and 2% naphthalene by weight, between 0.1 and 1.5% 1,2,4-trimethylbenzene by weight, and minor amounts of benzene (less than 0.5% by weight) and ethylbenzene (less than 0.05% by weight).

Table 1 illustrates suitable ranges of fuel additive components according to one embodiment of the present disclosure. This particular fuel additive embodiment includes potentially variable amounts of MTBE, saturated hydrocarbons, an organometallic compound, toluene, naphthalene, trimethylbenzene, benzene and ethylbenzene as noted by the ranges of weight percent.

TABLE 1

| Component | Weight % Range |
|---|---|
| MTBE | 35-55 |
| Heptane | 25-35 |
| HiTec ® 3062 | 5-12 |
| Toluene | 6-12 |
| Emsol 150 | 3-5 |
| Naphthalene | 0.5-1.5 |
| 1,2,4-Trimethylbenzene | 0.1-1.5 |
| Benzene | <0.25 |
| Ethylbenzene | <0.025 |

The saturated hydrocarbons used in the embodiment shown in Table 1 include heptane. The organometallic compound is methylcyclopentadienyl manganese tricarbonyl. HiTec® 3062 is a mixture of methylcyclopentadienyl manganese tricarbonyl (about 62% by weight), heavy aromatic naphtha, naphthalene and trimethylbenzene available from Afton Chemical Corporation (Richmond, Va.). Emsol 150 contains heavy aromatic naphtha and is available from Emco Chemical Distributors, Inc. (Chicago, Ill.). In other embodiments, Emsol 150 is replaced with other solutions containing heavy aromatic naphtha, such as Aromatic 150 or Solvesso™ 150 Fluid. Aromatic 150 is available from Megaloid Laboratories Limited (Oakville, ON, Canada). Solvesso™ 150 Fluid is available from Exxon Mobil Corporation (Houston, Tex.).

The fuel additive described above can be mixed with a liquid fuel composition containing a mixture of hydrocarbons in the gasoline boiling range to prepare a racing fuel composition. Between 28 grams (1 ounce) and 340 grams (12 ounces) of fuel additive can be mixed with 3.8 liters (1 gallon) of the liquid fuel composition to prepare the racing fuel composition. Larger and smaller quantities of the fuel composition can also be prepared at the ratios described above. The fuel additive can be pre-mixed with the liquid fuel composition before it is introduced into a vehicle's fuel tank. In other embodiments, the fuel additive can be added to an empty or partially empty vehicle fuel tank followed by the addition of additional liquid fuel composition. The further addition of liquid fuel composition causes sufficient mixing within the fuel tank to produce a uniform solution. Further still, the fuel additive can be added to a vehicle fuel tank that is nearly full of liquid fuel composition. Once the vehicle begins moving, the motion of the vehicle and vehicle vibration are enough to provide sufficient mixing of the liquid fuel composition and the fuel additive to form a uniform solution.

The racing fuel composition formed from mixing the fuel additive and the liquid fuel composition has an octane rating higher than that of the liquid fuel composition. The magnitude of the increase in octane rating depends on the octane rating of the liquid fuel composition and the amount of fuel additive added to the liquid fuel composition. For example, in one embodiment, adding 8 ounces of the fuel additive to 1 gallon of liquid fuel having an octane rating of 87 can produce a racing fuel having an octane rating of 100. Adding 8 ounces of the fuel additive to 1 gallon of liquid fuel having an octane rating of 91 can produce a racing fuel having an octane rating of 102. Adding 8 ounces of the fuel additive to 1 gallon of liquid fuel having an octane rating of 93 can produce a racing fuel having an octane rating of 105. In other embodiments, different amounts of the fuel additive, depending on the composition of the fuel additive, can provide similar levels of octane rating increases.

The fuel additive described herein allows racers to transport minimal amounts of fuel additive instead of larger amounts of racing fuel. Racers can add the fuel additive to normal gasoline to form a racing fuel suitable for high performance engines without the cost, risk and inconvenience of transporting racing fuel.

EXAMPLES

Engine tests were performed using conventional fuels and fuel compositions according to the present disclosure.

Tests were performed at RS Motors, Inc. in Burnsville, Minn.; TPiS, Inc. in Chaska, Minn.; and Tesar Engineering in Long Lake, Minn.

Each test followed the same methodology. An engine tuned to operate with a specific octane gasoline was connected to a dynometer with a water break to simulate load. The engine did a set of "pulls" (the engine was run from idle to redline) to determine the torque and horsepower of the engine on the fuel it was designed to use. The fuel injection system of the engine was then purged of the base fuel and was refilled with pump gasoline sourced from a local gas station that contained the fuel additive described herein. The engine then did a set of pulls with the gasoline containing the fuel additive. A number of different engines and different gasoline types were tested.

The fuel additive used in the tests described herein had the composition described in Table 2.

TABLE 2

| Component | Approximate Weight % |
|---|---|
| MTBE | 48.0 |
| Heptane | 32.0 |
| HiTec ® 3062 | 8.2 |
| Toluene | 8.0 |
| Emsol 150 | 3.2 |
| Naphthalene | 0.5 |
| 1,2,4-Trimethylbenzene | 0.2 |
| Benzene | 0.01 |
| Ethylbenzene | 0.01 |

In one set of tests, a Chevrolet Camaro 408 cubic inch LS3 engine was tested with 91 octane gasoline and with 91 octane gasoline containing 3.2 ounces of fuel additive per gallon of fuel. Results were collected from 2800 revolutions per minute (rpm) to 5900 rpm. Test results are shown in Table 3. The test using the mixture of gasoline and fuel additive demonstrated a higher average horsepower, a higher peak horsepower, a higher average torque and a higher peak torque.

TABLE 3

| | | Horsepower | | | Torque (lb · ft) | | |
|---|---|---|---|---|---|---|---|
| Engine | Fuel | Average | Peak | rpm | Average | Peak | rpm |
| 408 c.i. | 91 octane | 540.4 | 767.3 | 5500 | 668.5 | 752.1 | 5000 |
| LS3 | 91 octane + additive | 563.8 | 794.6 | 5600 | 682.1 | 763.8 | 5000 |
| | Results Δ | +23.4 | +27.3 | | +13.6 | +11.5 | |

In another set of tests, a Chevrolet 421 cubic inch engine was tested with 91 octane gasoline and with 87 octane gasoline containing 3.2 ounces of fuel additive per gallon of fuel. Results were collected from 2900 rpm to 6500 rpm. Test results are shown in Table 4. The test using the mixture of lower octane gasoline and fuel additive demonstrated a higher peak horsepower.

TABLE 4

| Engine | Fuel | Horsepower Peak | Horsepower rpm | Torque (lb · ft) Peak | Torque (lb · ft) rpm |
|---|---|---|---|---|---|
| 421 c.i. | 91 octane | 605.0 | 6000 | 549.9 | 5300 |
| | 87 octane + additive | 614.8 | 6300 | 548.9 | 5700 |
| | Results Δ | +9.8 | | −1.0 | |

In another set of tests, a 1969 Chevrolet Corvette BBC RG engine was tested with 116 racing fuel and with 87 octane gasoline containing 8 ounces of fuel additive per gallon of fuel Results were collected from 3500 rpm to 7000 rpm. Test results are shown in Table 5. The test using the mixture of lower octane gasoline and fuel additive demonstrated a higher peak horsepower and a higher peak torque compared to the higher octane racing fuel.

TABLE 5

| Engine | Fuel | Horsepower Peak | Horsepower rpm | Torque (lb · ft) Peak | Torque (lb · ft) rpm |
|---|---|---|---|---|---|
| Corvette BBC RG | 116 octane | 637.0 | 6800 | 547.2 | 5400 |
| | 87 octane + additive | 644.3 | 6800 | 570.0 | 4600 |
| | Results Δ | +7.3 | | +22.8 | |

In another set of tests, a Chevrolet 414 cubic inch LS3 engine was tested with E85 fuel blend and with 87 octane gasoline containing 4 ounces of fuel additive per gallon of fuel. Results were collected from 2900 rpm to 6600 rpm. Test results are shown in Table 6. The test using the mixture of gasoline and fuel additive demonstrated a higher peak horsepower and a higher peak torque.

TABLE 6

| Engine | Fuel | Horsepower Average | Horsepower Peak | Horsepower rpm | Torque (lb · ft) Average | Torque (lb · ft) Peak | Torque (lb · ft) rpm |
|---|---|---|---|---|---|---|---|
| 414 c.i. LS3 | E85 fuel blend | 429.5 | 579.0 | 6200 | 482.4 | 506.4 | 5900 |
| | 91 octane + additive | 447.0 | 582.5 | 6100 | 482.0 | 507.6 | 5800 |
| | Results Δ | +17.5 | +3.5 | | −0.4 | +1.2 | |

In another set of tests, a Ford Mustang 302 cubic inch engine was tested with 111 octane racing fuel and with 93 octane gasoline containing 4 ounces of fuel additive per gallon of fuel. Results were collected from 4000 rpm to 7000 rpm. Test results are shown in Table 7. The test using the mixture of lower octane gasoline and fuel additive demonstrated a higher peak torque and only a minimal reduction in peak horsepower compared to the higher octane racing fuel.

TABLE 7

| Engine | Fuel | Horsepower Peak | Horsepower rpm | Torque (lb · ft) Peak | Torque (lb · ft) rpm |
|---|---|---|---|---|---|
| 302 c.i. | 111 octane | 473.3 | 7000 | 379.4 | 5600 |
| | 93 octane + additive | 473.2 | 6900 | 381.9 | 5600 |
| | Results Δ | −0.1 | | +2.5 | |

In another set of tests, a Chevrolet 414 cubic inch LS3 engine was tested with 87 octane gasoline containing 3, 3.25 and 4 ounces of fuel additive per gallon of fuel, respectively. Results were collected from 2000 rpm to 6000 rpm. Test results are shown in Table 8. As the amount of fuel additive added to the gasoline increased, a corresponding increase in peak horsepower was observed.

TABLE 8

| Engine | Fuel | Horsepower Peak | Horsepower rpm | Torque (lb · ft) Peak | Torque (lb · ft) rpm |
|---|---|---|---|---|---|
| 414 c.i. LS3 | 3 oz. additive/gal. | 453.2 | 5900 | 437.6 | 5000 |
| | 3.25 oz. additive/gal. | 455.9 | 5900 | 437.2 | 4200 |
| | 4 oz. additive/gal. | 473.2 | 5700 | 447.6 | 4900 |

Additional testing demonstrated that 87 octane gasoline containing the fuel additive described herein had comparable performance to 105 octane racing fuel in a Chevrolet Corvette 414 cubic inch LS3 engine, and that 87 octane gasoline containing the fuel additive described herein had comparable performance to 116 octane racing fuel in a Pontiac 550 cubic inch engine.

The above results demonstrate that the fuel additive described herein improves the performance of a fuel composition, and in some cases, increases performance beyond that of a racing fuel having an octane rating as many as 29 points higher than the base fuel.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the appended claims.

The invention claimed is:

1. A fuel additive comprising:

methyl tert-butyl ether in an amount between 35% and 55% by weight;

saturated hydrocarbons in an amount between 25% and 35% by weight;

toluene in an amount between 6% and 12% by weight;

trimethylbenzene in an amount between 0.1 and 1.5% by weight; and an organometallic compound in an amount between 3% and 12% by weight.

2. The fuel additive of claim 1, further comprising:

heavy naphtha in an amount between 5% and 11% by weight; and naphthalene in an amount between 0.5% and 2% by weight.

3. The fuel additive of claim 2, further comprising:

no more than 0.25% benzene by weight; and no more than 0.025% ethylbenzene by weight.

4. The fuel additive of claim 1, wherein the organometallic compound comprises methylcyclopentadienyl manganese tricarbonyl (MMT).

5. The fuel additive of claim 4, wherein the saturated hydrocarbons are predominantly heptane.

6. The fuel additive of claim 5, wherein the fuel additive comprises:

methyl tert-butyl ether in an amount between 45% and 50% by weight;

heptane in an amount between 28% and 35% by weight; and

MMT in an amount between 3% and 5% by weight.

7. The fuel additive of claim 1, wherein the saturated hydrocarbons are isoalkanes.

8. The fuel additive of claim 7, wherein the saturated hydrocarbons are selected from the group consisting of isopentane, isoheptane, isooctane and combinations thereof.

9. A fuel composition comprising:

a major amount of a mixture of hydrocarbons in the gasoline boiling range; and a minor amount of a fuel additive comprising:

methyl tert-butyl ether in an amount between 35% and 55% by weight;

alkanes in an amount between 25% and 35% by weight;

toluene in an amount between 6% and 12% by weight;

trimethylbenzene in an amount between 0.1 and 1.5% by weight; and methylcyclopentadienyl manganese tricarbonyl in an amount between 3% and 12% by weight.

10. The fuel composition of claim 9, wherein the fuel additive comprises:

methyl tert-butyl ether in an amount between 45% and 50% by weight;

heptane in an amount between 28% and 35% by weight; and

MMT in an amount between 3% and 5% by weight.

11. The fuel composition of claim 9, wherein the ratio of the amount of the mixture of hydrocarbons to the amount of the fuel additive is between about 128:1 and about 128:12.

12. The fuel composition of claim 11, wherein the ratio of the amount of the mixture of hydrocarbons to the amount of the fuel additive is between about 128:3 and about 128:4.

13. A method of increasing the octane rating of a fuel, the method comprising:

adding a fuel additive to the fuel, the fuel additive comprising:

methyl tert-butyl ether in an amount between 35% and 55% by weight;

alkanes in an amount between 25% and 35% by weight;

toluene in an amount between 6% and 12% by weight;

trimethylbenzene in an amount between 0.1 and 1.5% by weight; and methylcyclopentadienyl manganese tricarbonyl in an amount between 3% and 12% by weight; and mixing the fuel additive and the fuel.

14. The method of claim 13, wherein the fuel additive comprises:

methyl tert-butyl ether in an amount between 45% and 50% by weight;

heptane in an amount between 28% and 35% by weight; and

MMT in an amount between 3% and 5% by weight.

15. The method of claim 13, wherein between one and twelve fluid ounces of fuel additive are added to one U.S. gallon of fuel.

16. The method of claim 15, wherein between three and four fluid ounces of fuel additive are added to one U.S. gallon of fuel.

* * * * *